US007037089B2

(12) United States Patent
Hsieh

(10) Patent No.: US 7,037,089 B2
(45) Date of Patent: May 2, 2006

(54) COOLING FAN HAVING DUAL BLADE SETS

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 144 days.

(21) Appl. No.: 10/852,200

(22) Filed: May 25, 2004

(65) Prior Publication Data

US 2005/0265864 A1 Dec. 1, 2005

(51) Int. Cl.
*F04B 17/00* (2006.01)

(52) U.S. Cl. ..... 417/368; 417/423.8; 415/77; 415/176; 416/175; 416/203

(58) Field of Classification Search ..... 417/368, 417/423.8; 415/77, 176; 416/175, 203
See application file for complete search history.

(56) References Cited

U.S. PATENT DOCUMENTS 6,050,786 A * 4/2000 Lin ..... 417/366
6,318,976 B1 * 11/2001 Hsieh ..... 417/423.12
2002/0122724 A1 * 9/2002 Tseng ..... 416/175

* cited by examiner

*Primary Examiner*—Timothy S. Thorpe
*Assistant Examiner*—Ryan Gillan
(74) *Attorney, Agent, or Firm*—Rosenberg, Klein & Lee

(57) ABSTRACT

A cooling fan with dual blade sets has an impeller formed by a rotatable hub, a stator assembly, and a shell. A plurality of mini blades and a plurality of guide blades are respectively formed on a bottom surface and an external surface of the rotatable hub. The impeller has a plurality of holes defined on the bottom surface being arranged in a circle adjacent to the mini blades. Therefore when the impeller rotates, the mini blades are able to drive out the heat in an inner space between the impeller and the shell through the holes to outside.

2 Claims, 2 Drawing Sheets

COOLING FAN HAVING DUAL BLADE SETS

BACKGROUND OF THE INVENTION

1. Field of the Invention

The present invention is related to a cooling fan having dual blade sets, and more particularly to a cooling fan that is able to draw out heat generated by the cooling fan itself.

2. Description of Related Art

Cooling fans are commonly used inside electronic devices and appliances for heat dissipation. The cooling fans are embedded in the host machines, such as computers and image projectors, to create an internal air flow in the inner space of the host machine, so that the internal heat can be quickly driven out during the operation of the host machine.

However, the stator and rotor of the fan motor themselves produce heat in order as they make the impeller turn. According to the conventional design of the cooling fans, the heat is usually trapped in the enclosed space between the impeller and the shell, which causes the temperature inside the cooling fan to rise continuously as long as the cooling fan is running. The rising temperature and built-up thermal pressure in the impeller will eventually cause thermal breakdown of the fan motor. Therefore, this is a problem which may shorten the normal service life of a cooling fan if not properly controlled.

SUMMARY OF THE INVENTION

The main objective of the present invention is to provide a cooling fan with dual blade sets, wherein the cooling fan employs an impeller with a plurality of mini blades and a plurality of guide blades which are respectively formed on a bottom surface and an outer surface of the impeller. A plurality of holes is further defined through the bottom surface of the impeller.

The mini blades are used to release the heat produced by the induced rotor and stator of the cooling fan through the holes to the outside, so as to control the working temperature over the stator of the fan motor. If the rising temperature in the continuous operation of the cooling fan can be controlled, the service life of the cooling fan will be extended.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
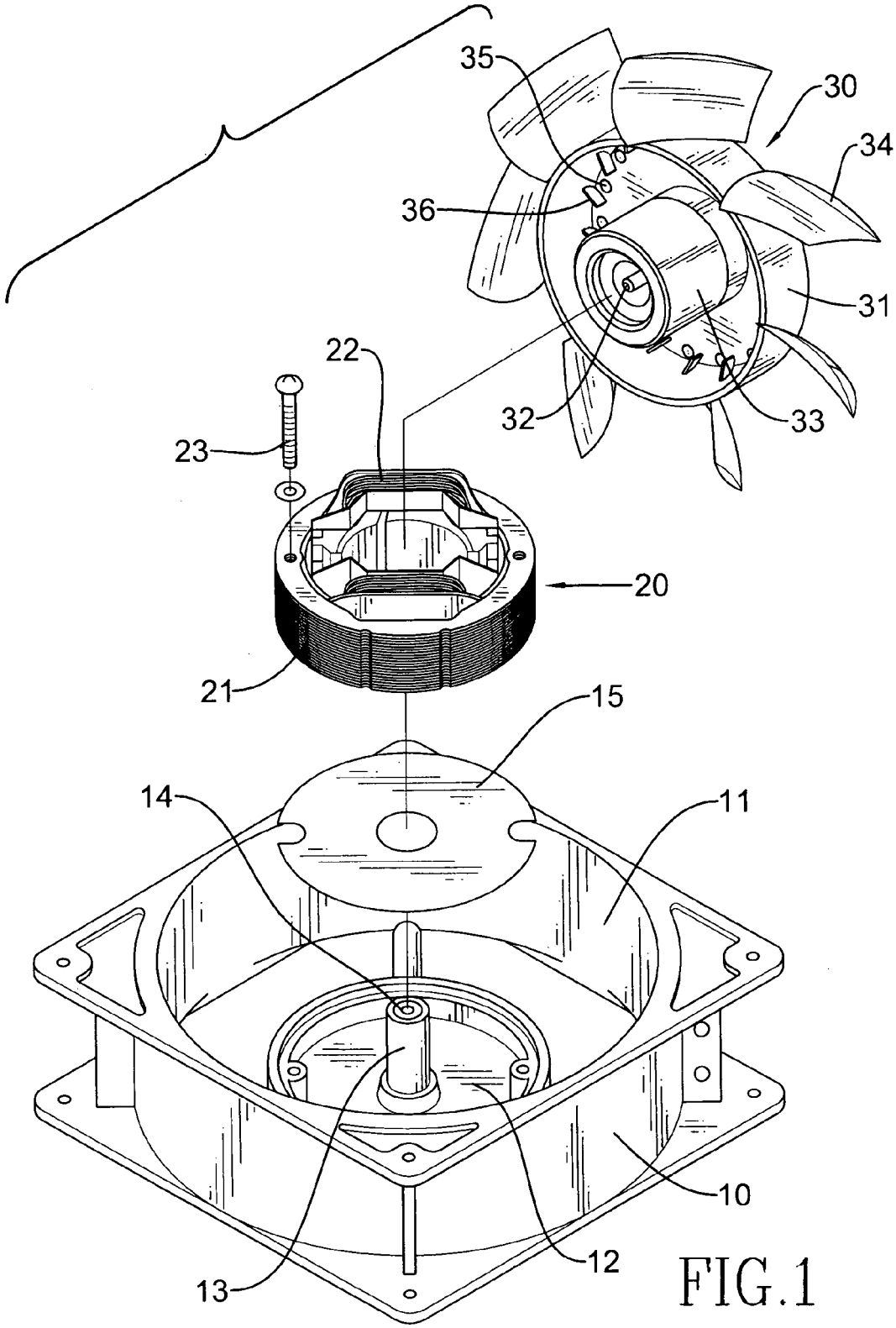
FIG. 1 is an exploded diagram of the cooling fan assembly.
Figure 2:
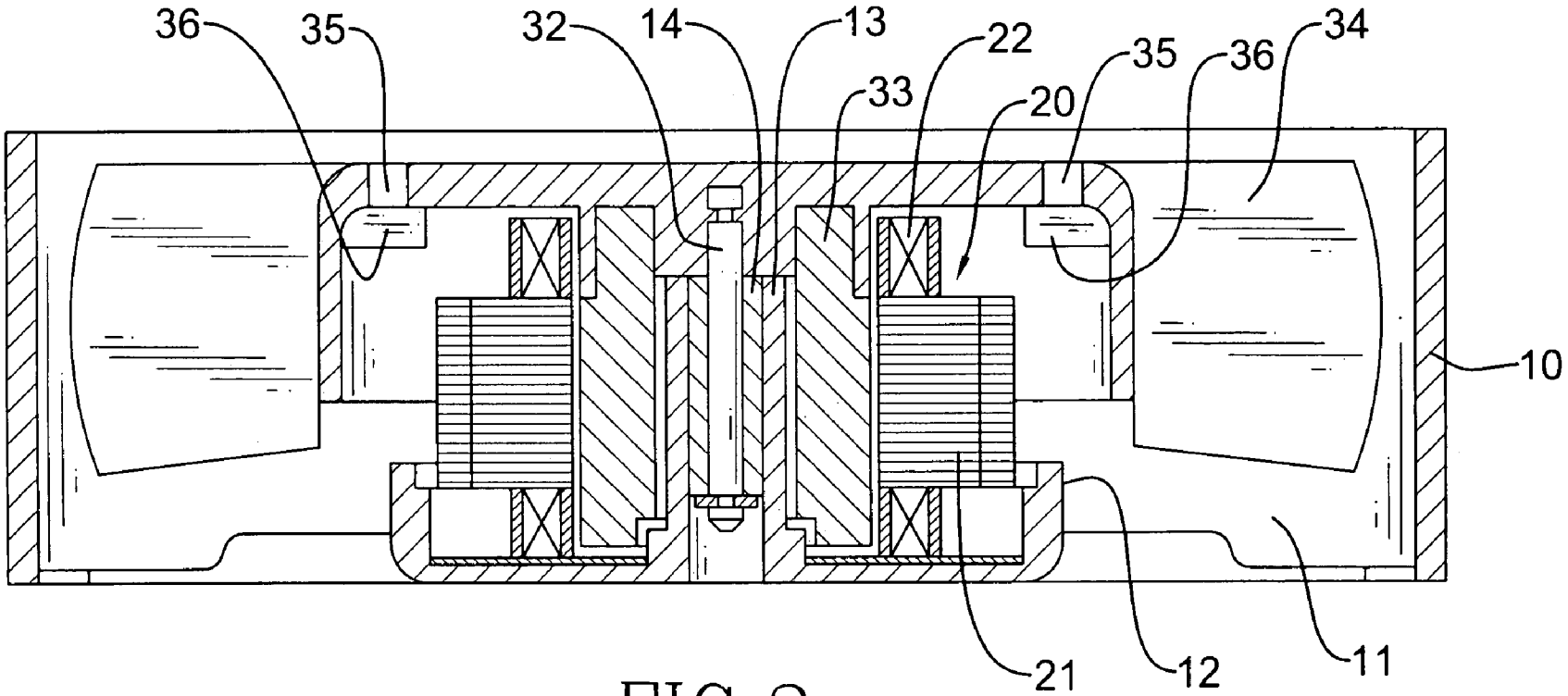
FIG. 2 is a cross-sectional view of the internal structure of the cooling fan assembly.

A cooling fan with dual blade sets in accordance with the present invention is illustrated in FIGS. 1 and 2.

The cooling fan is basically composed of an impeller (30), a stator assembly (20), and a shell (10).

The impeller (30) comprises a rotatable hub (31) having a bottom surface and an outer surface, a plurality of mini blades (36) formed on the bottom surface of the rotatable hub (31), and a plurality of guide blades (34) formed on the outer surface of the rotatable hub (31).

The impeller (30) further has a rotor (33) fixed at the center of the bottom surface of the rotatable hub (31), a spindle (32) extending from the rotatable hub (31) and a plurality of holes (35) defined through the bottom surface of the rotatable hub (31) and around the rotor (33). Each hole (35) is adjacent to a respective one of the mini blades (36).

Said rotor (33) and said stator (20) collectively form a motor of the cooling fan.

The stator assembly (20) is mounted at the bottom surface of the shell (10). The stator assembly (20) has a stacked yoke (21) with coils (22) wound across thereon. A pair of bolts (23) pass through the yoke (21) to securely mount the stator in the shell (10). An insulation sheet (15) is placed between the stator (20) and the shell (10).

The shell (10) has a housing (11) in its central part for accommodating the impeller (30), and a base plate (12) placed at the bottom of the shell (10), over which the stator (20) is mounted. A bearing (14) protrudes from the base plate (12) and is surrounded by a sleeve (13) from end to end. The insulation sheet (15), together with the stator assembly (20), is aligned with the bearing ring (14) at the center.

The spindle (32) extending from the rotatable hub (31) is to be inserted through the bearing (14), and the rotor (33) is to be coupled with the stator assembly (20) when assembling the cooling fan, whereby the bearing (14) and the stator assembly (20) are rotatably mounted at the center of the stationary shell (10).

The cooling fan of the present invention is characterized in that the impeller (30) has a dual blade set architecture which means the impeller (30) has the plurality of mini blades (36) formed in the bottom surface of the rotatable hub (31), and the guide blades (34) formed on the external surface of the rotatable hub (31). The plurality of holes (35) arranged in a circle around the rotor (33) are used in conjunction with the plurality of mini blades (36) for creating air flow in the housing (11) between the impeller (30) and the shell (10).

When poles of the rotor (33) and the stator assembly (20) are energized and induced, the mini blades (36), as well as the guide blades (34), rotate around the pivot in unison, such that the mini blades (36) are able to drive out the heat produced by the rotor (33) and the stator (20) while the cooling fan is running. The hot air exits through the holes (35) in the wall of the hub (31).

The operation of the cooling fan is explained hereinafter. Whenever the coils (22) are energized, a force is exerted on the poles of the stator assembly (20) and the rotor (33) to push the rotor (33) around the stator (20). Hence, the guide blades (34) and mini blades (36) on the impeller (30) are driven into rotation.

As the impeller (30) rotates, the guide blades (34) create an air flow in the direction of the cooling fan to cool down a host machine, and the mini blades (36) drive out the hot air trapped within the housing (11) between the impeller (30) and the shell (10) through the holes (35) in the bottom of the hub (31). Therefore, the fan-generated heat can be released through the holes (35) to the outside.

After releasing the heat, the working temperature over the stator assembly (20) can be effectively controlled. If the rising temperature in the continuous operation of the cooling fan can be controlled, the service life of the cooling fan will be extended. In conventional cooling fans, this generated heat is usually trapped in the housing (11) between the impeller (30) and the shell (10), eventually leading to thermal breakdown of the fan motor.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cooling fan having dual blade sets, comprising a shell (10), a stator assembly (20) mounted in the shell (10) and an impeller (30), wherein the impeller (30) has a rotatable hub (31) having a bottom surface and an outer surface, a rotor (33) with a spindle (32) mounted at the bottom surface of the rotatable hub (31), a plurality of mini blades (36) formed on the bottom surface of the rotatable hub (31), a plurality of guide blades (34) formed on the outer surface of the rotatable hub (31) and a plurality of holes (35) defined through the bottom surface of the rotatable hub (31), wherein each hole (35) is adjacent to a respective one of the mini blades (36);

the stator assembly (20) is mounted in the shell (10) by using bolts (23), wherein an insulation sheet (15) separates the stator (20) and the shell (10); and the shell (10) defines a housing (11) with a bottom plate (12) to receive the stator assembly and the impeller (30), wherein a bearing (14) surrounded by a sleeve (13) extends from the bottom plate (12), such that the insulation sheet (15) and stator assembly (20) are to be aligned with the bearing (14) at the center;

when the stator assembly (20) is mounted over base plate (12), the rotor (33) is coupled with the stator (20), and the spindle (32) extending from the rotatable hub (31) is inserted through the bearing (14), wherein as the impeller (30) rotates, the guide blades (34) create an air flow to cool down a host machine, and the mini blades (36) drive out hot air within the housing (11) between the impeller (30) and the shell (10) and through the holes (35).

2. The cooling fan according to claim 1, wherein the plurality of holes (35) is arranged in a circle around the rotor (33) on the bottom surface of the rotatable hub (31).

* * * * *